United States Patent [19]

Zajac

[11] Patent Number: 4,603,616

[45] Date of Patent: Aug. 5, 1986

[54] ROTARY ACTUATOR

[75] Inventor: Theodore S. Zajac, Bay Village, Ohio

[73] Assignee: Zaytran Inc., Elyria, Ohio

[21] Appl. No.: 605,656

[22] Filed: Apr. 30, 1984

Related U.S. Application Data

[63] Continuation-in-part of Ser. No. 497,862, May 25, 1983, abandoned.

[51] Int. Cl.[4] ..... F01B 3/00

[52] U.S. Cl. ..... 92/33; 92/178

[58] Field of Search ..... 92/32, 33, 178; 91/405, 91/406, 410; 74/89.15; 308/6 R

[56] References Cited

U.S. PATENT DOCUMENTS

| | | | |
|---|---|---|---|
| 3,165,982 | 1/1965 | Taylor | 92/33 |
| 3,905,277 | 9/1975 | Rosell | 91/400 |
| 3,961,559 | 6/1976 | Teramachi | 92/33 X |

FOREIGN PATENT DOCUMENTS

| | | |
|---|---|---|
| 0034069 | 8/1981 | European Pat. Off. . |
| 2060547 | 9/1971 | Fed. Rep. of Germany . |
| 2244897 | 4/1973 | Fed. Rep. of Germany . |
| 2701717 | 7/1977 | Fed. Rep. of Germany . |
| 26813 | 1/1964 | German Democratic Rep. . |

*Primary Examiner*—Albert W. Davis, Jr.
*Assistant Examiner*—Randolph A. Smith
*Attorney, Agent, or Firm*—Yount & Tarolli

[57] ABSTRACT

A rotary actuator is operable under the influence of fluid pressure to rotate a driven member. The rotary actuator includes a drive member which extends into a chamber in a housing. Helical splines interconnect a piston and the drive member to rotate the drive member upon axial movement of the piston in the chamber. The piston is held against rotary movement relative to the housing in one embodiment by a pair of rollers that engage tracks disposed on opposite sides of the piston and in another embodiment by a corresponding oval-shaped configuration of a portion of the piston and an internal portion of the chamber in the housing. In one embodiment of the invention, a rack gear on the piston rotates a pinion to actuate a valve and restrict fluid flow to the chamber when the piston is approaching an end-of-stroke position. A one-way clutch may be connected with the drive member so that the driven member is only rotated in one direction rather than being oscillated upon back and forth movement of the piston.

5 Claims, 7 Drawing Figures

ROTARY ACTUATOR

CROSS-REFERENCE TO RELATED APPLICATION

This application is a continuation-in-part of my copending application Ser. No. 497,862, filed May 25, 1983 now abandoned.

BACKGROUND OF THE INVENTION

The present invention relates to a rotary actuator which is operable under the influence of fluid pressure to rotate a drive member.

A known rotary actuator includes two internal and two external splines. Thus, the known actuator assembly includes a drive member upon which external helical splines are formed. Internal splines on a piston sleeve engage the splines on the drive member. External splines on the piston sleeve are engaged by a stationary ring gear. Fluid pressure causes the piston sleeve to move axially in a motor cylinder chamber.

As the piston sleeve of this known rotary actuator moves in the chamber, the external helical spline on the drive member and the internal helical spline on the piston sleeve cause the drive member to rotate. In addition, the interaction between the helical spline on the outside of the piston sleeve and the stationary ring gear causes the piston sleeve to rotate. This rotational movement of the piston sleeve is transmitted to the drive member. Since the piston sleeve both rotates and moves axially in the motor cylinder chamber, a seal between the piston and the sidewall of the motor cylinder chamber is subjected to both rotational and axial sliding friction. In addition there are substantial sliding friction losses between the two internal splines and the two external splines.

U.S. Pat. No. 3,961,559 discloses an actuator which includes a piston member which has an internal helical spline and which cooperates with a shaft member on which is fixed an external helical spline. The piston member, when it moves axially on the shaft member, causes rotation of the shaft member due to the cooperation of the helical splines. The piston member itself is restrained from rotating due to the fact that the piston member is located in an oval-shaped cylinder. Fluid pressure applied to opposite sides of the piston will cause the piston to move in one direction or the other and when the piston moves axially relative to the shaft, it will cause rotation of the shaft due to the cooperation of the helical splines between the piston and the shaft. It is necessary in this design not only to provide fluid seals between the outer diameter of the piston and the internal diameter of the cylinder, but also to provide fluid seals between the helical splines of the piston and shaft. Such seals are extremely difficult to manufacture and are not durable and reliable in operation.

BRIEF SUMMARY OF THE INVENTION

A rotary actuator constructed in accordance with the present invention includes a piston which is axially movable in a chamber. Internal helical splines connected with the piston engage external helical splines on a drive member to rotate the drive member as the piston moves axially in the chamber. One feature of the rotary actuator embodying the present invention is the fact that the rotary actuator does not require a fluid seal between the internal helical splines on the piston member and the external helical splines on the shaft. In fact, fluid leakage through the internal and external helical splines on the piston and shaft, respectively, is permitted. The unique construction that permits fluid leakage through the helical spline interconnection between the piston and the shaft includes a cavity formed in the piston member into which the drive shaft telescopically extends. The mating of the external and internal helical splines occurs within the cavity. The pressure in the cavity is permitted to communicate with the pressure against a first face of the piston to which the cavity opens. The cavity opens only toward one face of the piston. Fluid pressure may act against this first face of the piston to move the piston in one direction. The portion of the piston that defines the cavity has a portion which projects radially outwardly and includes a second face against which fluid pressure may act to move the piston in an opposite direction from the one direction. Fluid pressure against the second face is sealed by a sealing means from communication with the first face of the piston and the cavity located within the piston member.

In accordance with another feature of the present invention, the piston of the present rotary actuator is held against rotation in a unique manner. In one embodiment, the piston is held against rotation by a pair of rollers which engage tracks disposed on opposite sides of the piston. Therefore a seal between the piston and a wall of the chamber is subjected to only sliding friction.

During axial movement of the piston, the interaction between the internal and external helical splines results in relatively large reaction forces which tend to rotate the piston about its central axis. These reaction forces are transmitted to the actuator assembly housing through the rollers and tracks. Due to the rolling action between the rollers and tracks and the anti-friction bearing construction of the rollers, frictional resistance to axial movement of the piston tends to be minimized. Frictional resistance to axial movement of the piston also tends to be minimized by having the piston engage the sidewall of the chamber only at a relatively short head end portion of the piston.

In accordance with a modified embodiment of the present invention, the piston may be prevented from rotating due to an oval-shaped construction formed on one portion of the piston. In this embodiment, the piston comprises a member which defines the cavity into which the drive shaft telescopically extends and into which fluid, which is directed to one side of the piston, may flow. One portion of the piston is circular and carries an O-ring seal which seals against a cooperating cylinder chamber portion of the housing. Another portion of the piston is oval in configuration and is located in a cooperating oval-shaped chamber portion of the housing. The cooperating oval configurations of a portion of the piston and a portion of the chamber of the housing prevents rotation of the piston in the housing. Fluid pressure is directed to the ends of the piston to control movement thereof within the housing unit. The O-ring seal on the circular portion of the piston member prevents leakage of fluid from the one end of the piston to the other end of the piston. This O-ring seal is again subject to only sliding friction.

In accordance with another feature of the present invention, fluid flow that controls movement of the piston may be restricted to decrease the speed of movement of the piston as the piston approaches an end-of-stroke position. This can be accomplished by having a rack gear on the piston rotate a pinion which is operatively connected with a valve. As the piston approaches an end-of-stroke position, rotation of the pinion actuates the valve to restrict fluid flow to the chamber. If desired, the pinion could operate electrical limit switches and also various electronic position or velocity transducers.

When the rotary actuator is used in certain environments, it may be desirable to have the drive member rotate in only one direction rather than oscillate about its central axis as the piston moves back and forth in the chamber. This can be accomplished by providing a one-way clutch between the drive member and an output from the rotary actuator. The one-way clutch is effective to transmit rotational force only when the drive member is being rotated in a selected direction.

BRIEF DESCRIPTION OF THE DRAWINGS

The foregoing and other objects and features of the present invention will become apparent to those skilled in the art upon consideration of the following description of preferred embodiments taken in connection with the accompanying drawings wherein.

DESCRIPTION OF SPECIFIC PREFERRED EMBODIMENTS OF THE INVENTION

Rotary Actuator—First Embodiment

Figure 1:
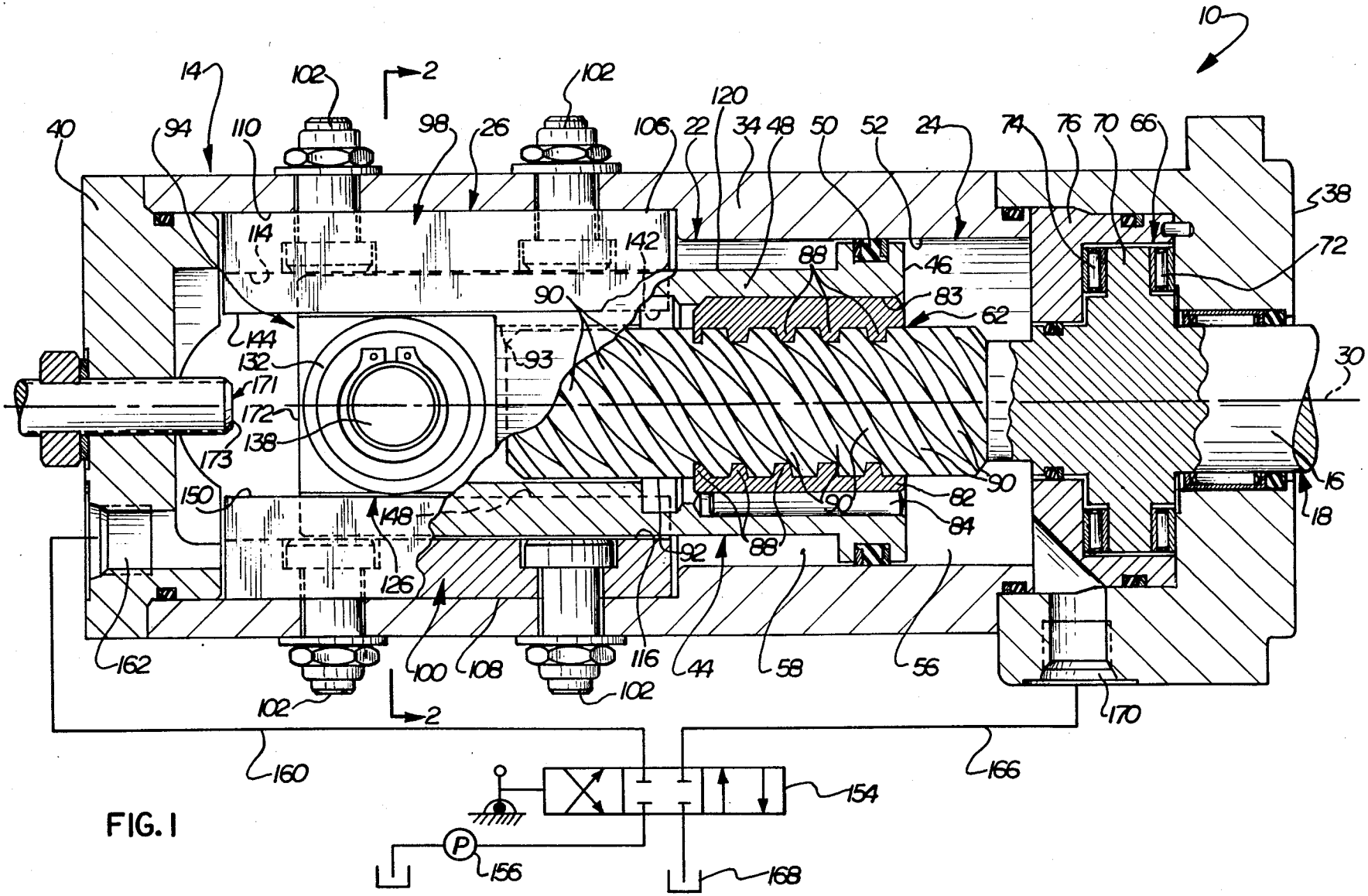
FIG. 1 is a sectional view of a rotary actuator constructed in accordance with the present invention.

A rotary actuator 10 (FIG. 1) is operated under the influence of fluid pressure to rotate a driven member (not shown). It is contemplated that the rotary actuator 10 can be used to rotate many different types of driven members. For example, the rotary actuator 10 can advantageously be used to rotate a boom or a working tool for mining or construction equipment.

The rotary actuator 10 includes stationary housing 14 which is securely connected to a base or support structure (not shown). During operation of the rotary actuator 10, an output end portion 16 of a drive member 18 rotates a driven member.

The housing 14 defines a cylindrical chamber 22 having a front section 24 and a somewhat larger diameter rear section 26. The cylindrical front and rear chamber sections 24 and 26 are disposed in a coaxial relationship with a central axis 30 about which the drive member 18 is rotated.

The housing 14 includes a main section 34 through which the cylindrical chamber 22 extends. A front flange or cover 38 is fixedly connected to a base or support structure. The cover 38 is also connected to one end of the main section 34 of the housing. A rear end cover 40 is fixedly connected to the opposite end of the main section 34 of the housing.

A hollow cylindrical piston 44 is axially movable in the chamber 22. The piston 44 has a relatively large diameter annular head section 46 at one end of a body section 48. An annular seal 50 in the head section 46 of the piston slidably engages a cylindrical inner side surface 52 of the front section 24 of the chamber 22. The head section 46 divides the cylindrical front section 24 of the chamber 22 into front and rear variable volume chambers 56 and 58.

During operation of the rotary actuator 10, the piston 44 moves along the central axis 30 of the rotary actuator under the influence of fluid pressure in one of the variable volume chambers 56 or 58. During axial movement of the piston 44, a helical force transmitting assembly 62 rotates the drive member 18 about the axis 30. The drive member 18 is supported for rotary motion relative to the housing 14 by a thrust bearing assembly 66.

The drive member 18 has a circular flange 70 which projects radially outward from a cylindrical main section of the drive member 18. An annular front thrust bearing 72 is disposed between the flange 70 and the front cover 38 of the housing 14. An annular rear thrust bearing 74 is disposed between the flange 70 and a fixedly mounted bearing adapter or housing 76. The bearing assembly 66 supports the drive member 18 for rotational movement about the axis 30 while holding the drive member against axial movement along the axis. If desired, the thrust bearing assembly 66 could be constructed of a pair of hydrostatic thrust bearings. These bearings would receive fluid pressure and flow from the actuator hydraulic supply.

The helical force transmitting assembly 62 rotates the drive member 18 about the axis 30 when the piston 44 is moved axially in the chamber 22. The helical force transmitting assembly 62 includes an externally threaded nut 82 which is held against rotation in an internally threaded bore 83 in the piston 44 by a mounting pin 84. The pin 84 is disposed in a hole between an outer side surface of the nut 82 and the inner side surface of the piston 44.

The nut 82 has helical inner splines 88 which engage helical outer splines 90 on an input end portion 92 of the driven member 18. Upon axial movement of the piston 44 in the chamber 22, the interaction between the helical splines 88 on the nut 82 and the helical splines 90 on the drive member 18 cause the drive member to rotate about the central axis 30 in a known manner. As the hollow piston 44 moves to the right (as viewed in FIG. 1), the telescopic relationship between the drive member 18 and the piston 44 increases. Similarly, as the piston 44 moves to the left (as viewed in FIG. 1), the telescopic relationship between the piston and the drive member 18 decreases.

The piston member 44, as disclosed above, is hollow in configuration and specifically defines a cavity 93 which is closed at its end remote from the end where the nut 82 is located. The cavity 93 is closed by a wall which extends transverse to the axis 30. As a result, fluid pressure which is communicated to the chamber 56 to cause movement of the piston toward the left is permitted leak through the helical gears or helical splines into the cavity portion 93. Thus, a seal between the helical gears is unnecessary. Fluid pressure which is communicated to the chamber 58 to cause movement of the piston to the right is isolated from the chamber 56 and from the cavity 93 by the seal 50 and also by the transverse wall or cup-shaped configuration of the piston 44.

A retainer assembly 94 holds the piston 44 against rotation about the axis 30 while allowing the piston to move along the axis. The retainer assembly 94 includes upper and lower arcuate shoe segments 98 and 100 (see FIGS. 1 and 2) which are disposed on opposite sides of the rear section 26 of the chamber 22 and are fixedly connected to the body section 34 of the housing 14 by a plurality of bolts 102. The arcuate shoe segments 98 and 100 have outer side surfaces 106 and 108 which are portions of a cylinder and are disposed in abutting engagement with the cylindrical inner side surface 110 of rear section 26 of the chamber 22.

The upper and lower shoe segments 98 and 100 have arcuate inner side surfaces 114 and 116 which form a portion of a cylinder which is coaxial with and has a smaller diameter than the inner side surface 52 of the front section 24 of the chamber 22. The surfaces 114 and 116 on the inside of the shoe segments 98 and 100 extend along a cylindrical outer side surface 120 of the piston 44.

In order to minimize frictional resistance to axial movement of the piston 44, the inner side surfaces 114 and 116 of the shoe segments 98 and 100 are separated from the outer side surface 120 of the piston. This results in sliding engagement of the piston 44 with a stationary component of the rotary actuator 10 at only the seal 50 between the housing and the relatively short head end 46 of the piston. The space between the body section 48 of the piston 44 and the arcuate shoe segments 98 and 100 minimizes any tendency for the piston to bind in the chamber 24.

The shoe segments 98 and 100 cooperate to form a pair of straight tracks 124 and 126 (FIG. 2) disposed along opposite sides of the piston 44. The tracks 124 and 126 extend parallel to the central axis 30 and are engaged by rollers 130 and 132 disposed on opposite sides of the piston 44. The rollers 130 and 132 are rotatably mounted on a pair of coaxial stub shafts 136 and 138 which project diametrically outwardly from opposite sides of the piston 44. Upon axial movement of the piston 44 in the chamber 24, the rollers 130 and 132 roll along the tracks 124 and 126 to minimize frictional resistance to axial movement of the piston.

The linear tracks 124 and 126 (FIG. 2) are formed by minor side surfaces of the shoe segments 98 and 100. Thus, the upper shoe segment 98 has a pair of downwardly facing minor side surfaces 142 and 144 which are engaged by upper portions of the rollers 130 and 132. Similarly, upwardly facing minor side surfaces 148 and 150 on the lower shoe segment 100 are engaged by the lower portions of the rollers 130 and 132. The minor side surfaces 148 and 150 on the lower shoe segment 100 extend parallel to the minor side surfaces 142 and 144 of the upper shoe segment 98 and to the central axis 30 of the actuator assembly 10. Therefore, during axial movement of the piston 44, the rollers 130 and 132 cooperate with the tracks 124 and 126 to hold the piston against rotation about the central axis 30 and to guide axial movement of the piston along the axis.

Operation—First Embodiment

To effect operation of the rotary actuator 10, a directional control valve 154 (FIG. 1) is actuated from the illustrated initial position blocking fluid flow from a pump 156 to the rotary actuator 10. Actuation of the directional control valve 154 ports high pressure fluid to one of the variable volume chambers 56 or 58 to cause axial movement of the piston 44. Of course this axial movement of the piston results in rotation of the drive member 18 about its central axis 30.

Assuming that the drive member 30 is to be rotated in a clockwise direction (as viewed from the front or output end of the actuator assembly 10), the valve 154 is actuated to direct high pressure fluid from the pump 156 to a fluid conduit 160 connected with a rear housing port 162. This high pressure fluid moves along the tracks 124 and 126 to the rear variable volume chamber 58 to urge the piston 44 toward the right (as viewed in FIG. 1). Actuation of the valve 154 also connects the fluid conduit 166 with the reservoir 168 to enable fluid to be exhausted from the front variable volume chamber 56 through port 170.

As the piston 44 moves toward the right (as viewed in FIG. 1) the internal splines 88 on the nut 82 cooperate with the external splines 90 on the input end portion 92 of the drive member 18 to rotate the drive member about its central axis 30 in a known manner. As the piston 44 moves toward the right (as viewed in FIG. 1), the rollers 130 and 132 roll along the linear tracks 124 and 126.

Due to the interaction between the internal and external splines 88 and 90, the piston 44 tends to rotate with the output shaft 18 so that the roller 132 is pressed downwardly (as viewed in FIGS. 1 and 2) against the upwardly facing side surface 150 on the lower shoe segment 100 while the roller 130 (FIG. 2) is pressed upwardly against the side surface 142 on the upper shoe segment 98. Since the shoe segments 98 and 100 are fixedly connected to the housing 14, the piston 44 is held against rotation about the axis 30 by the interaction between the rollers 130 and 132 and the tracks 124 and 126. The reaction force is transmitted directly from the rollers 130 and 132 to the shoe segments 98 and 100 which are fixedly connected with the housing 14. Of course, the housing 14 is fixedly connected to a base.

Since the piston 44 only moves axially along the drive member 18 and does not rotate, the seal 50 is subjected to only sliding friction forces. This enhances the operating life of the seal. If the piston 44 was allowed to rotate relative to housing 14, the seal 50 would be subjected to both sliding friction forces and rotation frictional forces. The resulting combination of forces would be detrimental to the operating life of the seal.

If it was desired to rotate the drive member 18 in a counterclockwise direction, as viewed from the front of the rotary actuator 10, the valve 154 would be actuated to port high pressure fluid to the conduit 166 and the left or front variable volume chamber 56. This would result in the piston 44 being moved axially toward the rear or right as viewed in FIG. 1. As the piston 44 moves toward the right, the internal splines 88 on the nut 82 cooperate with the external splines 90 on the drive member 18 to rotate the drive member. As the piston 44 moves toward the right (as viewed in FIG. 1) the rollers 130 and 132 cooperate with the tracks 124 and 126 to hold the piston 42 against rotation. At this time the roller 130 would be pressed upwardly against the minor side surface 142 of the upper shoe segment 98 while the roller 132 would be pressed downwardly against the minor side surface 150 of the lower shoe segment 100.

An end-of-stroke adjusting screw 171 is provided in the rear flange or cover 40. When the piston moves toward the right to an end-of-stroke position, an end surface 172 on the piston 44 abuts an end surface 173 on the end-of-stroke screw 171. By rotating the end-of-stroke screw 171 the position of the surface 173 can be adjusted to thereby adjust the end-of-stroke position of the piston 44.

If desired, a port could be provided in the end cap or cover to supply lubricant in the thrust bearing assembly 66.

Rotary Actuator—Second Embodiment

Figure 4:
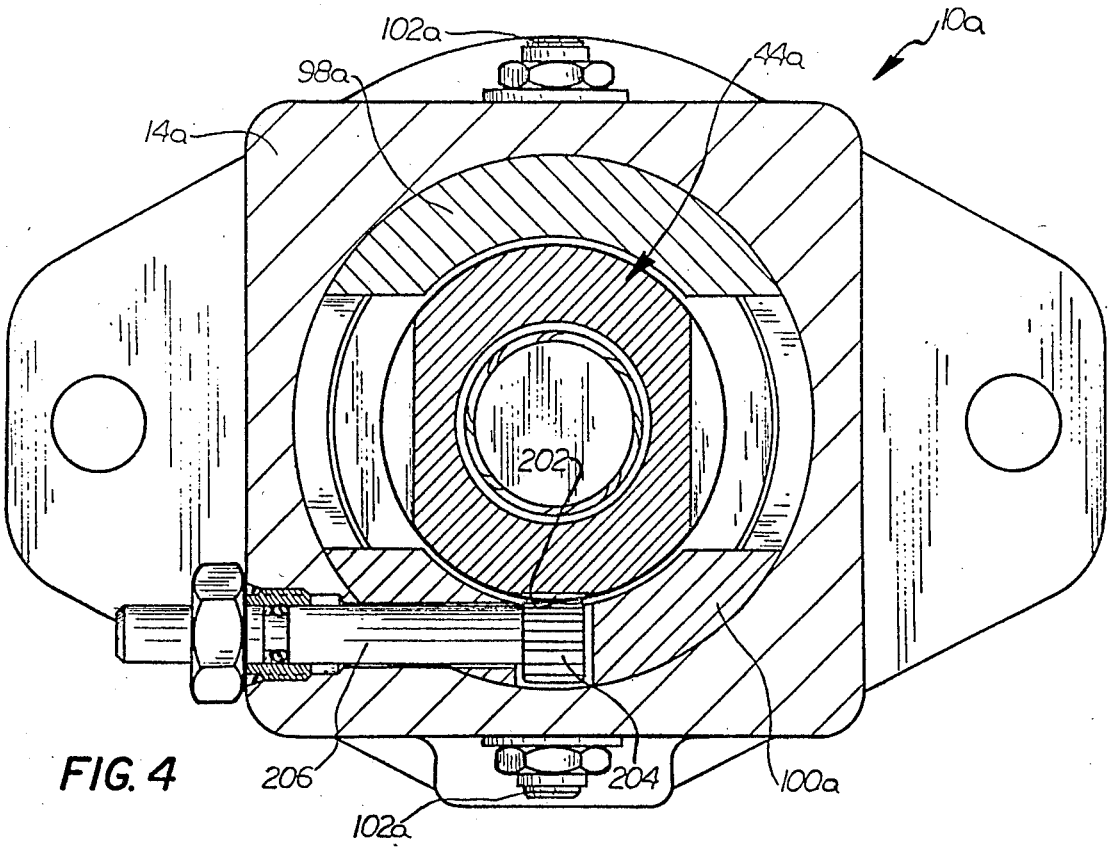
FIG. 4 is a sectional view, taken generally along the line 4—4 of FIG. 3, illustrating the relationship between a rack gear connected with the piston and a pinion which is rotatably mounted on the housing and driven by the rack gear upon axial movement of the piston.

In order to minimize impact loading to the components of the rotary actuator when the piston approaches an end-of-stroke position, it is contemplated that it may be desirable to gradually restrict the flow of high pressure fluid to the rotary actuator as the piston reaches an end-of-stroke position. In the embodiment of the invention illustrated in FIGS. 3 and 4, a control apparatus is associated with the rotary actuator to restrict the flow of fluid to the rotary actuator as the piston approaches the end-of-stroke position. Since the embodiment of the invention shown in FIGS. 3 and 4 is generally similar to the embodiment of the invention shown in FIGS. 1 and 2, similar numerals will be used to identify similar components, the suffix letter "a" being associated with FIGS. 3 and 4 in order to avoid confusion.

Figure 3:
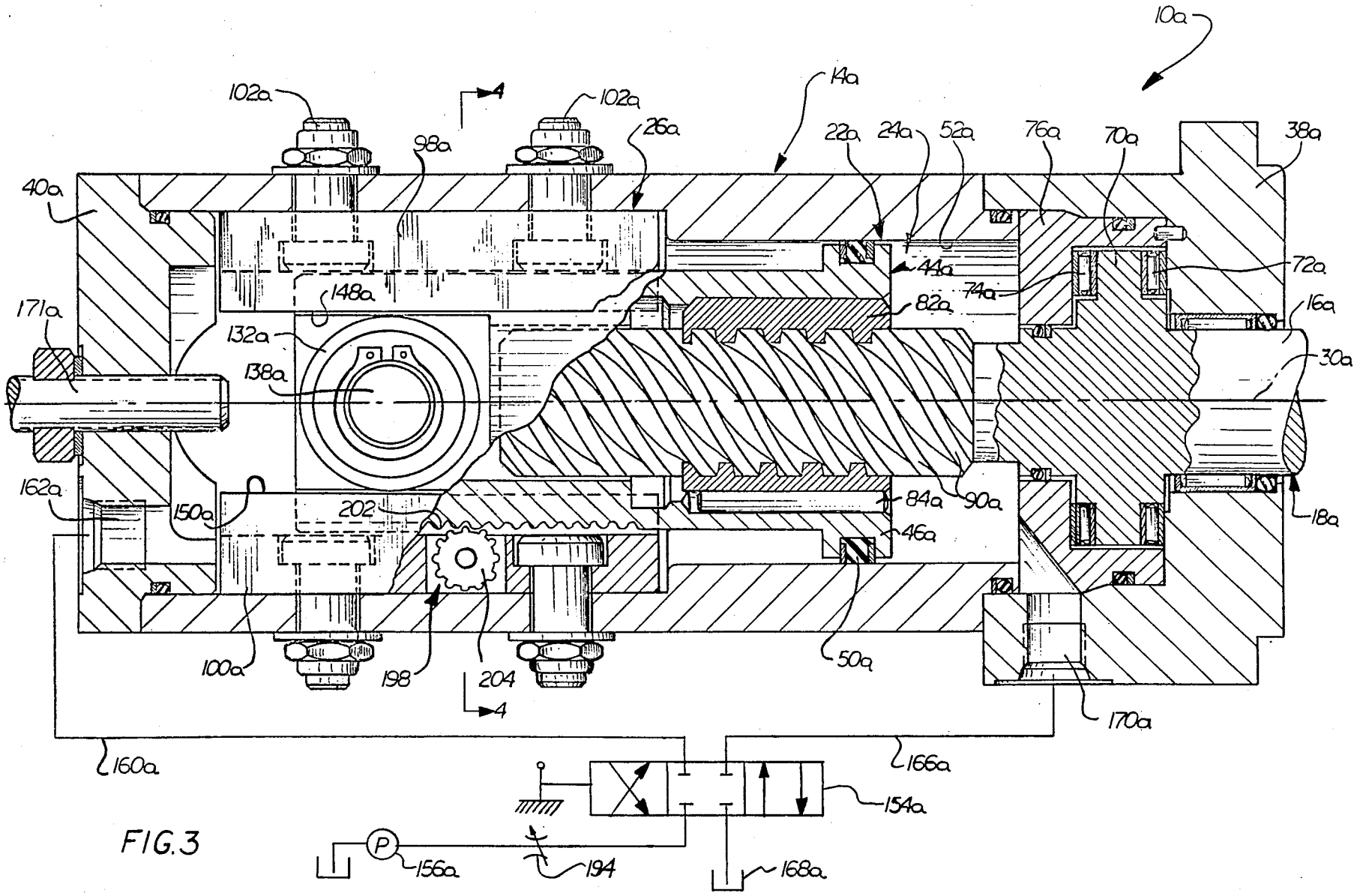
FIG. 3 is a sectional view, generally similar to FIG. 1, of an embodiment of the invention in which a flow of fluid to a motor cylinder chamber is restricted as the piston approaches an end-of-stroke position.

In the embodiment of the invention shown in FIG. 3, a flow modulation valve 194 is provided between the directional control valve 154*a* and the pump 156*a*. When the piston 44*a* approaches an end-of-stroke position, the flow modulation valve 194 is actuated to gradually restrict the flow of fluid to the rotary actuator 10*a*. The valve 194 is actuated by a rack and pinion assembly 198 as the piston 44*a* moves in the chamber 22*a*.

The rack and pinion assembly (FIG. 3) includes a rack gear 202 formed on the upper side of the piston 44*a*. The rack gear 202 meshingly engages a pinion 204 at one end of an auxiliary shaft 206 (FIG. 4). The auxiliary shaft 206 is rotatably supported by the housing 14*a* and upper shoe segment 98*a*.

The auxiliary shaft 206 is connected with the flow modulation valve 194. The valve 194 is constructed so that rotation of the shaft 206 is effective to cause the valve to start to restrict fluid flow to the rotary actuator 10*a* only when the piston 44*a* is approaching an end-of-stroke position. To accomplish this, the flow modulation valve 194 can be constructed with a relatively long port which is tapered at its ends.

During the central or main portion of the stroke of the piston 44*a*, the long, constant area, central portion of the port in the flow modulation valve 194 is ineffective to restrict fluid flow to the rotary actuator 10*a*. As the piston 44*a* approaches an end-of-stroke postion, one of the tapered ends on the port begins to restrict fluid flow to the rotary actuator 10*a*. When the piston reaches an end-of-stroke position, the valve 194 severely restricts, but does not completely block, the flow of fluid to the rotary actuator 10*a*. This results in the piston 44*a* gradually slowing down as it approaches the end-of-stroke position.

Of course, the flow modulation valve 194 could have many different constructions. For example, the valve 194 could be solenoid actuated from the fully open condition to a closed condition partially blocking fluid flow to the rotary actuator 10*a*. If this was done, it is contemplated that a rotary switch would be connected, through a gear train, with the auxilary shaft 206 so that as the piston approached an end-of-stroke position, the rotary switch would close a contact which would energize the solenoid and operate the flow modulation valve to partially block fluid flow to the rotary actuator 10*a*.

Although the flow modulation valve 194 has been disclosed as being between the valve 154*a* and the pump 156*a*, it is contemplated that the restrictor could be placed at other locations if desired. For example, the valve 194 could be located between the valve 154*a* and the rotary actuator 10*a* in the conduit 166*a* through which fluid is exhausted from the rotary actuator. Of course, the flow modulation valve 94 could also be connected with the conduit 160*a* if desired.

Rotary Actuator—Third Embodiment

The embodiments of the rotary actuator shown in FIGS. 1–4 transmit oscillating rotary motion upon reciprocation of the piston 44 or 44*a*. Thus, upon movement of the piston in one direction, the drive member 18 or 18*a* is rotated in a clockwise direction, while upon movement of the piston in the opposite direction, the drive member 18 or 18*a* is rotated in the opposite direction. It is contemplated that it may be desirable to use the rotary actuators of FIGS. 1–4 in an environment in which a driven member is rotated in only one direction.

Figure 5:
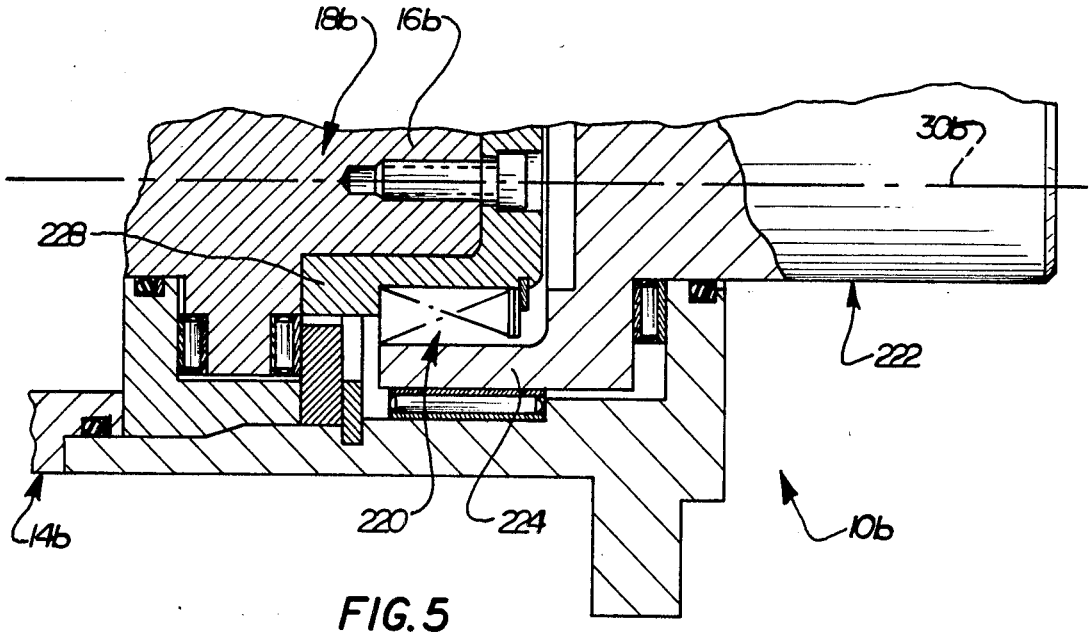
FIG. 5 is a fragmentary sectional view of an embodiment of the invention in which the output from the rotary actuator is transmitted through a one-way clutch.

In the embodiment of the invention illustrated in FIG. 5, a one-way clutch is provided in the rotary actuator so that an output member from the rotary actuator is rotated in only one direction. Since the embodiment of the invention illustrated in FIG. 5 is generally similar to the embodiment of the invention illustrated in FIGS. 1–4, similar numerals will be utilized to designate similar components, the suffix letter "b" being associated with the numerals of FIG. 5 to avoid confusion.

A rotary actuator 10*b* has a housing 14*b* in which a one-way overriding clutch 220 is disposed between an output end portion 16*b* of a drive member 18*b* and a final drive or output member 222 for the rotary actuator assembly 10*b*. The final output member 222 has a cylindrical wall 224 which extends around the one-way clutch 220. An annular connector member 228 is connected to the end 16*b* of the drive member 18*b* and to the overriding clutch 220.

Upon movement of the piston toward the left and rotation of the drive member 18*b* in a clockwise direction, the clutch 220 transmits the rotary motion to the final output member 222 to rotate the final output member in the same direction, that is in a clockwise direction. Upon movement of the piston toward the right and rotation of the drive member 18*b* in the opposite direction, that is in a counterclockwise direction, the one-way clutch 220 does not transmit rotary motion to the final drive member 222. Therefore, the final drive member 222 remains stationary during movement of the piston in one direction and rotates during movement of the piston in the opposite direction. Of course, the one-way clutch 220 could be constructed in such a manner that the final drive member 222 would be driven only in a counterclockwise direction.

Figure 7:
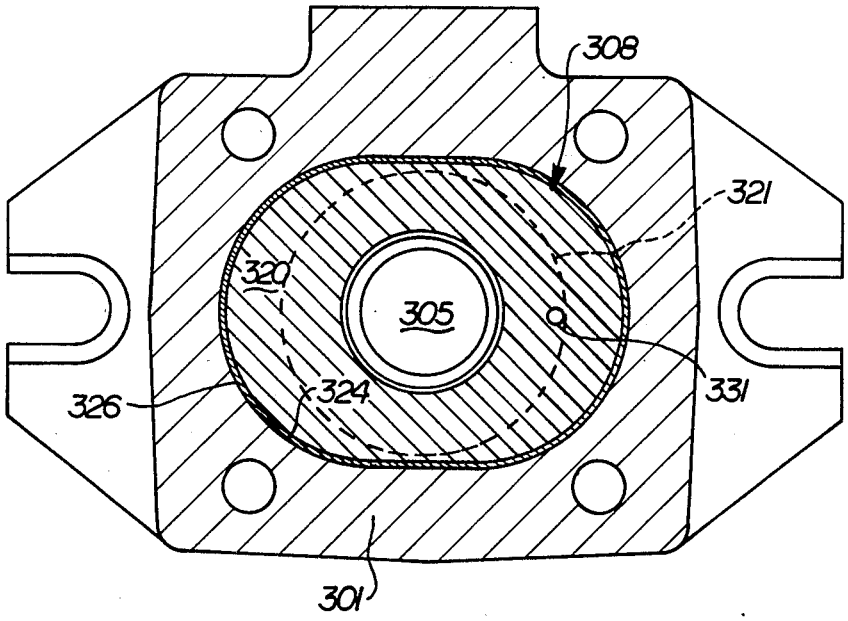
FIG. 7 is a sectional view of the rotary actuator taken along the line 7—7 of FIG. 6.
Figure 6:
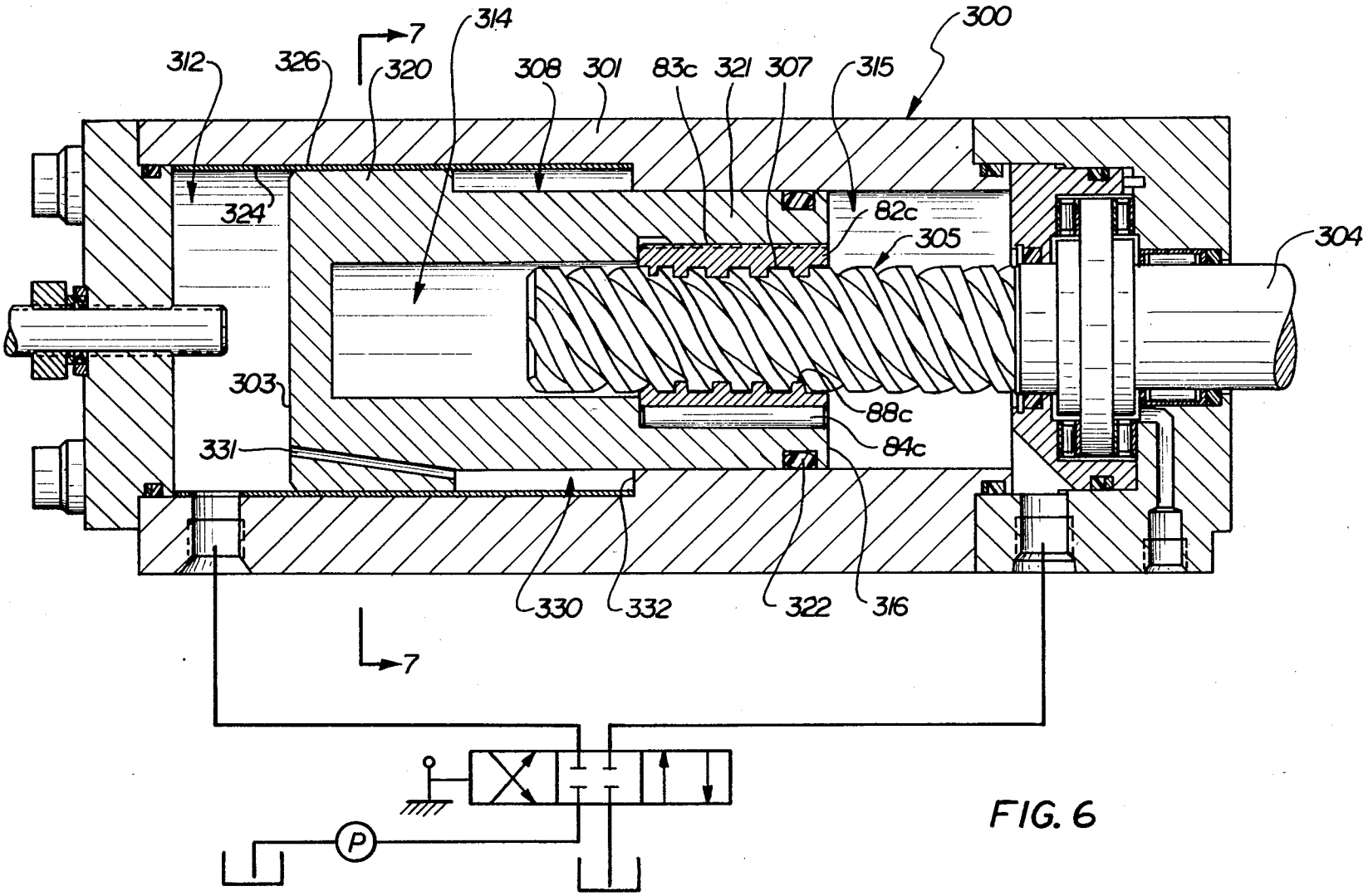
FIG. 6 is a sectional view of a rotary actuator similar to the actuator of FIG. 1 but of a modified construction.

FIGS. 6 and 7 illustrate another embodiment of a rotary actuator embodying the present invention. The rotary actuator in FIG. 6 includes a housing 300. The piston member, generally designated 308, is located in the chamber of the housing member 301 and moves axially in the housing member 301 relative to the shaft 305.

A nut 82c, which is held against rotation in an internally threaded bore 83c of the piston 308 by a mounting pin 84c, has inner splines 88c that engage the helical outer spline 307 of the shaft 305.

When the piston member 308 moves axially in one direction, the output end portion 304, which is an integral extension of shaft 305, will rotate as shaft 305 rotates in the corresponding direction because of the helical spline connection between the nut 82c held in the piston 308 and splines 307 on the shaft 305. When the piston 308 moves in the reverse direction, the output end portion 304 will rotate in the reverse direction, again because of the helical spline connection between the nut 82c held in the piston 308 and the splines 307 on the shaft 305. To effect movement of the piston 308 in one direction, for example, to the right as is shown in FIG. 6, fluid pressure is applied to a chamber 312 located at the left end of the piston 308. It should be clear that the fluid pressure which acts in the chamber 312 acts on a rear end face 303 of the piston 308. The piston 308 is a generally hollow piston member and the shaft 305 telescopically extends into a cavity 314 located interiorly of the piston 308. When fluid pressure is applied to the chamber 312, that fluid pressure acts on the rear face 303 of the piston 308 and causes the piston 308 to move to the right. This causes a telescopic relationship to occur between the piston 308 and the shaft 305.

When it is desired to cause the output end portion 304 to rotate in the opposte direction, the piston 308 is moved to the left in FIG. 6. This is accomplished by fluid being delivered to the chamber 315 located on the right side of the piston 308. When fluid is delivered to the chamber 315, the fluid acts on the face 316 and the piston 308 will move to the left causing a rotation of the shaft 305 and thus the rotation of output end portion 304.

The axial movement of the piston to the left and right effects rotation of the output end portion 304 because the piston itself is prevented from rotating. Specifically, the left end of the piston 308, as shown in FIGS. 6 and 7, includes an oval-shaped portion 320 which projects radially outwardly from the main body of the piston 308. The oval-shaped portion 320 slidably engages a frictionless surface 324, which is secured internally to a correspondingly oval-shaped portion 326 of the housing 301. The cooperating oval-shaped configuration of the portion 320 and the portion 326 prevents rotation of the piston 308 with respect to the housing 301. The lining 324 may be of any suitable frictionless material, such as "Rulon" manufactured by Dixon Industries Corporation, Bristol, R.I. When the housing 301 is constructed of a bearing grade material such as bronze, cast iron or ductile iron, the lining 324 may be omitted since the piston surface will be hardened.

The right end of the piston 308 is circular and is designated 321. The right end of the piston 321 carries an O-ring seal 322 which provides a seal between the piston 308 and the housing member 301.

A chamber 330 is provided between a shoulder 332 of the housing member 301 and the radially extending oval portion 320. A suitable fluid passage 331 is provided to permit communication between the chamber 330 and the chamber 312.

The chamber 315 likewise is in fluid communication with the cavity 314, because fluid leakage is permitted between the helical splines on the piston and the helical splines on the shaft 305. This fluid leakage permits the piston 303 to move toward the left and right without restriction. It will be appreciated that the cavity 314 is in fluid communication only with the chamber 315 and therefore forms part of chamber 315. Therefore, the helical nut 82c as well as the cavity 314 are contained entirely within the chamber 315.

Figure 2:
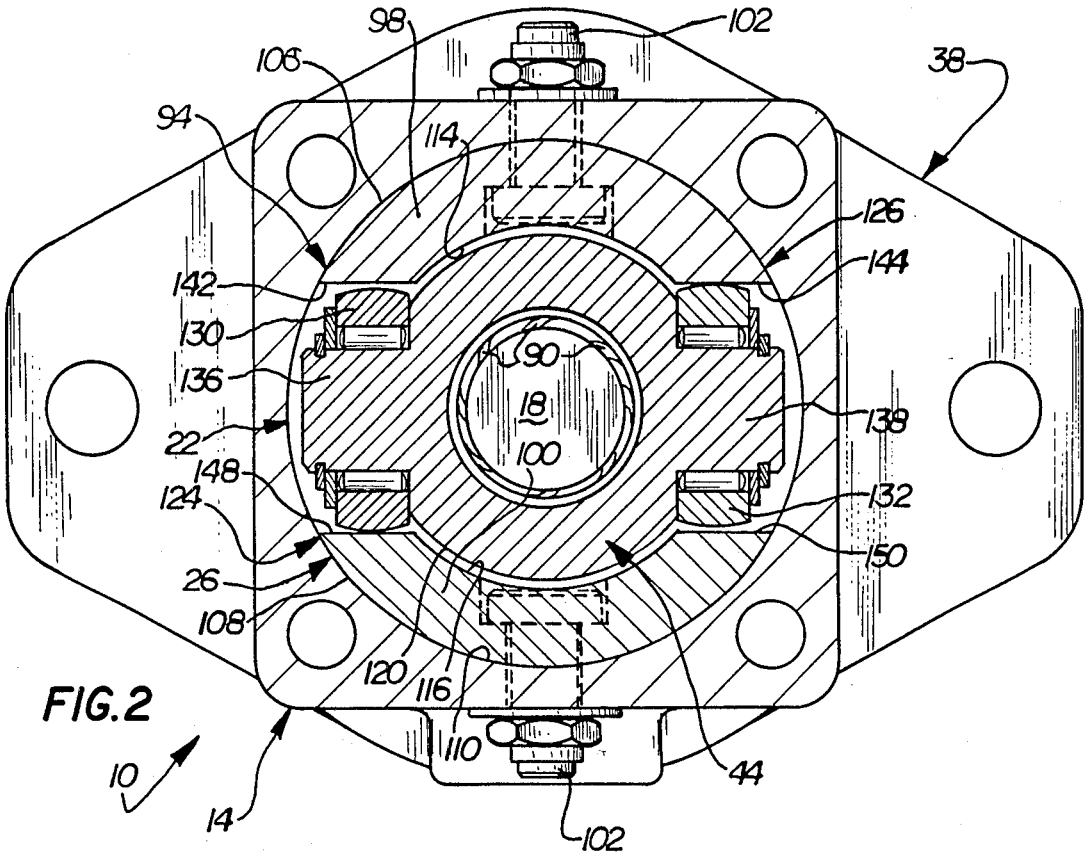
FIG. 2 is a sectional view, taken generally along the line 2—2 of FIG. 1, illustrating the relationship between a pair of rollers connected with a piston of the rotary actuator and a pair of tracks disposed on opposite sides of the piston.

Thus, it should be clear that the embodiment of FIGS. 6 and 7 is similar to the embodiment of FIG. 1, except the means of preventing rotation of the piston in the embodiment of FIGS. 6 and 7 is a corresponding oval-shaped configuraion of a portion of the piston and a portion of the housing 301.

SUMMARY

A rotary actuator 10 constructed in accordance with the present invention includes a piston 44 which is axially movable in a chamber 22. Internal helical splines 88 on a nut 82 connected with a piston 44 engage external helical splines 90 on a drive member 16 to rotate the drive member as the piston moves axially in the chamber. The piston 44 is held against rotation by a pair of rollers 130 and 132 which engage tracks 124 and 126 disposed on opposite sides of the piston 44. As the piston moves axially in the motor cylinder chamber and rotates the drive member 16, the rollers roll along the tracks 124 and 126 and cooperate with the tracks to hold the piston against rotational movement. Therefore, the seal 50 between the piston 44 and the sidewall 52 of the chamber 22 is subjected to only sliding friction.

Also, in the embodiment of FIG. 6, the piston member has an oval-shaped configuration on an end thereof that prevents rotation of the piston member as the piston is moved axially. Further, in both embodiments of FIGS. 1 and 6, the spline connection between the piston and the drive shaft is such that a seal is unnecessary therebetween. This is due to the fact that the piston is of a hollow configuration and specifically generally cup-shaped to allow the piston and drive shaft to telescope. The interior of the piston defines a cavity which is permitted to be at the same pressure as the pressure on the one end of the piston to which the cavity opens.

In the embodiment of FIG. 1, during axial movement of the piston 44, the interaction between the internal and external helical splines 88 and 90 results in relatively large reaction forces which tend to rotate the piston about its central axis 30. These reaction forces are transmitted to the stationary housing 14 through the rollers 130 and 132 and the tracks 124 and 126. Due to the rolling action between the rollers 130 and 132 and the tracks 124 and 126, frictional resistance to axial movement of the piston tends to be minimized. Frictional resistance to axial movement of the piston 44 also tends to be minimized by having the piston engage the side wall 52 of the chamber 24 only at the relatively short head end portion 46 of the piston. The body portion 48 of the piston 44 is spaced from the arcuate shoe segments 98 and 100 to eliminate sliding friction and any possible binding interaction between the piston and shoe segments.

Fluid flow to the chamber may be restricted to decrease the speed of movement of the piston 44a as the piston approaches an end-of-stroke position. This can be accomplished by having a rack gear 202 on the piston 44a rotate a pinion 44 which is operatively connected with a valve or restrictor 194. As the piston 44*a* approaches an end-of-stroke position, rotation of the pinion 204 actuates the valve 194 to partially block fluid flow to the chamber 22.

When the rotary actuator is used in certain environments, it may be desirable to have the drive member 16 rotate in only one direction rather than oscillate about its central axis 30 as the piston 44 moves back and forth in the motor cylinder chamber. This can be accomplished by providing a one-way clutch 220 between the drive member 16 and an output from the rotary actuator. The one-way clutch 220 is effective to transmit rotational force only when the drive member is being rotated in a selected direction.

Having described specific preferred embodiments of the invention, the following is claimed:

1. Apparatus comprising:

a housing having a chamber, a drive member mounted for rotation in said housing and extending into said chamber, a piston disposed for axial movement in said chamber, helical force transmitting means interconnecting said piston and said drive member for rotating said drive member with respect to said piston in response to axial movement of said piston, port means for communicating fluid pressure to opposite ends of said piston to move said piston axially in opposite directions, respectively, a fluid seal carried by said piston and sealingly engaging said piston and the surface of said chamber to provide fluid isolation between said opposite ends of said piston, said housing having a first surface portion for guiding said piston in its axial movement and for preventing rotation of said piston due to the action of said force transmitting means, said first surface portion defining a first portion of said chamber which is noncircular in its cross-section taken transverse to the axis of said piston, and said housing having a second surface portion defining a second portion of said chamber which is circular in its cross-section taken transverse to the axis of said piston, said piston having one portion located in said first portion of said chamber and having a noncircular cross section corresponding to the cross-section of said first portion of said chamber, and said piston having another portion located in said second portion of said chamber and having a circular cross-section corresponding to the cross-section of said second portion of said chamber, said fluid seal being carried by said circular portion of said piston and sealingly engaging said second surface portion of said housing.

2. The apparatus of claim 1 wherein said piston has a cavity with an open end for telescopically receiving said drive member, said cavity having a bottom wall and a tubular circumferential wall extending between said bottom wall and said open end, said helical force transmitting means having a first portion fixed to an interior surface of said tubular circumferential wall and a second portion integral with said drive member, and the fluid pressure in said cavity being substantially equal to the fluid pressure applied to an end of said piston defined by said another portion thereof.

3. The apparatus of claim 1 comprising valve means for directing fluid pressure to said port means.

4. The apparatus of claim 1 wherein the maximum dimension of the cross-section of said first portion of said chamber and of said one portion of said piston are greater than the diameter of said second portion of said chamber and said another portion of said piston.

5. The apparatus of claim 4 wherein said one portion of said piston has conduit means for communicating a part of said first portion of said chamber adjacent said second portion of said chamber with an end of said piston defined by said one portion thereof.

* * * * *